US005734363A

United States Patent [19]

Blouin et al.

[11] Patent Number: 5,734,363

[45] Date of Patent: Mar. 31, 1998

[54] METHOD AND APPARATUS FOR PRODUCING SHADING ON A FLAT PANEL DISPLAY

[75] Inventors: François Alexandre Blouin; Paul Provençal, both of Hull, Canada

[73] Assignee: Northern Telecom Limited, Montreal, Canada

[21] Appl. No.: 502,717

[22] Filed: Jul. 14, 1995

[51] Int. Cl.[6] ..... G09G 3/36

[52] U.S. Cl. ..... 345/89; 345/147; 345/149

[58] Field of Search ..... 345/88, 89, 90, 345/114, 189, 147, 148, 149

[56] References Cited

U.S. PATENT DOCUMENTS

| | | | |
|---|---|---|---|
| Re. 33,532 | 2/1991 | Ishii | 340/793 |
| 4,757,470 | 7/1988 | Bruce et al. | 364/900 |
| 4,984,887 | 1/1991 | Yoshioka | 350/332 |
| 5,018,076 | 5/1991 | Johary et al. | 364/518 |
| 5,065,147 | 11/1991 | Rice et al. | 340/744 |
| 5,119,086 | 6/1992 | Nishioka et al. | 340/793 |
| 5,194,746 | 3/1993 | Coen et al. | 250/563 |
| 5,196,839 | 3/1993 | Johary et al. | 340/793 |
| 5,337,408 | 8/1994 | Fung et al. | 395/162 |
| 5,552,800 | 9/1996 | Uchikoga et al. | 345/89 |

FOREIGN PATENT DOCUMENTS

WO 92/22887 12/1992 WIPO .

*Primary Examiner*—Mark R. Powell
*Assistant Examiner*—Matthew Luu
*Attorney, Agent, or Firm*—John A. Granchelli

[57] ABSTRACT

A display system that encodes shading in an image to be displayed. The system comprises a video display having a plurality of pixel elements each being mapped to a respective bit within a memory, and a controller for energizing, at a predetermined frame refresh rate, the pixel elements according to an image bitmap stored in the memory. An energizing pattern of successive frames, which defines the shading by indicating for each frame whether the pixels of the display generally are to be on or off, is utilized by a processor to generate, at the refresh rate, an encoded bitmap by manipulating bits of a source bitmap as a function of the energizing pattern for each of the frames, and storing the encoded bitmap in the memory.

28 Claims, 4 Drawing Sheets

| GRAY LEVEL | FRAME SEQUENCE | | | | | | | |
|---|---|---|---|---|---|---|---|---|
| | 1 | 2 | 3 | 4 | 5 | 6 | 7 | 8 |
| 0 | 0 | 0 | 0 | 0 | 0 | 0 | 0 | 0 |
| 1 | 0 | 0 | 0 | 0 | 0 | 0 | 0 | 1 |
| 2 | 0 | 0 | 0 | 0 | 0 | 0 | 1 | 1 |
| 3 | 0 | 0 | 1 | 0 | 0 | 1 | 0 | 1 |
| 4 | 0 | 0 | 0 | 0 | 1 | 1 | 1 | 1 |
| 5 | 1 | 0 | 1 | 0 | 1 | 0 | 1 | 0 |
| 6 | 1 | 0 | 1 | 0 | 1 | 0 | 1 | 1 |
| 7 | 1 | 1 | 1 | 1 | 1 | 1 | 1 | 1 |

METHOD AND APPARATUS FOR PRODUCING SHADING ON A FLAT PANEL DISPLAY

BACKGROUND OF THE INVENTION

The present invention generally relates to display systems and, in particular, to a method and apparatus for producing levels of shading on flat panel displays. Shading includes gray scale shading on monochrome flat panel displays and color shading on electrically controlled birefringence color flat panel displays.

It is common today for telephone sets to include a display unit, for example, to inform the receiving person of the name and number of the entity originating a telephone call. The display unit may be based on monochrome and electrically controlled birefringence color flat panel display technologies including liquid crystal, electro-luminescence, plasma and the like. The typical flat panel display is formed as an array of individual pixels, each of which may be independently illuminated through application of an appropriate voltage thereto. Display controllers having digital interfaces are generally used to drive flat panel displays by applying a constant voltage to specific pixels during a given refresh frame.

Various techniques are know to generate varying levels of shading on flat panel displays. Frame rate control (FRC) is one such technique, whereby a series of refresh frames are utilized during which the constant voltage may or may not be applied to the pixels in the display, effectively varying the duty cycle of the energizing voltage. This technique modulates each pixel between two display intensities, namely off and full luminance, over a period of several frames and the integrating characteristic of the human eye tends to perceive the luminance or intensity of the pixel as being at a shade somewhere between the two intensities. For example, if the duty cycle (between the two intensities) is 50% then the eye will perceive the shade as being approximately 50% (i.e., the transient response of the pixels is typically nonlinear). As the duty cycle is varied less or more than 50% the eye will also see this as a dimmer or brighter shade.

Display controllers embodied in integrated circuits which implement the Frame Rate Control technique for driving flat panel displays exist today. However, the commercially available controllers are designed for large size displays and laptop applications, and consequently the cost of these hardware devices is relatively high.

It is therefore desirous to have a low cost solution to generate various levels of shading that is particularly suited for smaller applications, for instance, to effect gray scaling on the smaller size monochrome liquid crystal displays typically utilized in telephone sets.

SUMMARY OF THE INVENTION

It is an object of the present invention to provide a new and improved method and apparatus to produce shading on a flat panel display. "Shading" refers to both gray scale shades on a monochrome display and color shades on an electrically controlled birefringence color display.

According to a first broad aspect of the invention, there is provided a method for use in a display system to encode shading in an image to be displayed, the system including a video display having a plurality of pixel elements each being mapped to a respective bit within a memory, and a controller for energizing, at a predetermined frame refresh rate, the pixel elements according to an image bitmap stored in the memory, the method comprising the steps of: generating a source bitmap representative of the image; specifying an energizing pattern of successive frames, the pattern defining the shading by indicating for each frame whether the pixels of the display generally are to be on or off; generating, at the refresh rate, an encoded bitmap by manipulating bits of the source bitmap as a function of the energizing pattern for each of the frames; and storing the encoded bitmap in the memory.

According to a second broad aspect of the invention, there is provided a method for use in a display system to encode shading in an image to be displayed, the system including a video display having a plurality of pixel elements each being mapped to a respective bit within a memory, and a controller for energizing, at a predetermined frame refresh rate, the pixel elements according to an image bitmap stored in the memory, the method comprising the steps of: generating a source bitmap consisting of a foreground and a background of the image; specifying first and second energizing patterns, each pattern defining a level of shading by indicating for successive frames whether the pixels of the display generally are to be on or off, the first pattern being the level of shading for the foreground and the second pattern being the level of shading for the background; generating, at the refresh rate, an encoded bitmap by manipulating bits of the source bitmap as a function of the first and second energizing patterns for each of the frames; and storing the encoded bitmap in the memory.

According to a third broad aspect of the invention, there is provided a display system that encodes shading in an image to be displayed, comprising: a video display having a plurality of pixel elements each being mapped to a respective bit within a memory; a controller for energizing, at a predetermined frame refresh rate, the pixel elements according to an image bitmap stored in the memory; a source bitmap representative of the image; an energizing pattern of successive frames, the pattern defining the shading by indicating for each frame whether the pixels of the display generally are to be on or off; and means for generating, at the refresh rate, an encoded bitmap by manipulating bits of the source bitmap as a function of the energizing pattern for each of the frames, and storing the encoded bitmap in the memory.

According to a fourth broad aspect of the invention, there is provided a display system that encodes shading in an image to be displayed, comprising: a video display having a plurality of pixel elements each being mapped to a respective bit within a memory; a controller for energizing, at a predetermined frame refresh rate, the pixel elements according to an image bitmap stored in the memory; a source bitmap consisting of a foreground and a background of the image; first and second energizing patterns, each pattern defining a level of shading by indicating for successive frames whether the pixels of the display generally are to be on or off, the first pattern being the level of shading for the foreground and the second pattern being the level of shading for the background; and means for generating, at the refresh rate, an encoded bitmap by manipulating bits of the source bitmap as a function of the first and second energizing patterns for each of the frames, and storing the encoded bitmap in the memory.

The invention is advantageous in that the frame rate control technique to effect shading is integrated into the image processing and may be readily implemented in firmware. Therefore, lower cost conventional display microcontrollers and digital drivers may be utilized for energizing the pixels of the display.

BRIEF DESCRIPTION OF THE DRAWINGS

The invention will be better understood from the following description of a preferred embodiment of a flat panel display system together with reference to the accompanying drawings, in which.

DETAILED DESCRIPTION OF PREFERRED EMBODIMENT

Figure 1:
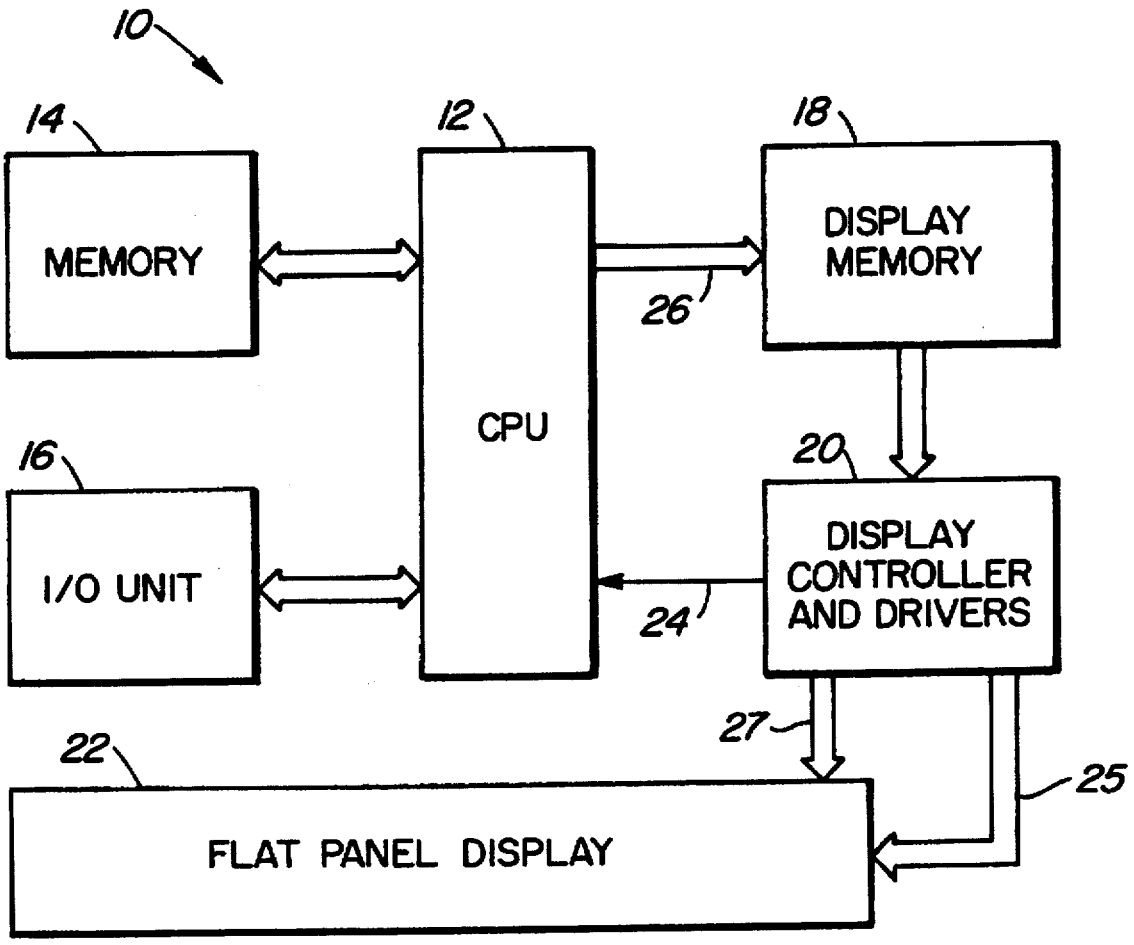
FIG. 1 is a block diagram of the flat panel display system.

Referring to FIG. 1, illustrated is a display system 10 that may be utilized in telephone sets (not shown) having enhanced capabilities, for example, to display the name and telephone number of an entity originating a telephone call. The display system 10 includes a central processing unit (CPU) 12 interfacing with a memory 14, an input/output unit 16, a display memory 18, and a display controller 20 which interfaces with a flat panel display 22 and also with the display memory 18. The memory 14 is a general representation of both RAM and ROM memories with which the CPU 12 normally interacts.

The input/output unit 16 represents the means by which the telephone set may interact with its external environment. It may consist of a link to the public switched telephone network and a keypad as an input device for users of the telephone.

The flat panel display 22 is a conventional device consisting of a matrix of individual illumination or pixel elements being addressable by row and column bus lines. It may be based on monochrome and electrically controlled birefringence color technologies, such as liquid crystal (LC), electro-luminescence, plasma and the like. Monochrome LC displays are preferred because LC pixels generally have a slow response which facilitates the use of frame rate control techniques to effect shading. Moreover, the flat panel display 22 is advantageously a smaller size display that consequently requires less processing time on the part of the CPU 12 to implement the frame rate control technique, in accordance with the invention. A suitable display 22, for example, may be 32 rows in height and 120 columns in width. In a text base display application having a character size of 5×8 pixels, such a display provides four lines and twenty-four characters/line of information.

In the following, the invention is described in terms of the display system 10 having a monochrome LC display 22, and the implementation of gray scale shading therein. It, however, should be understood that the invention may readily be adapted to other types of display technology including electrically controlled birefringence color flat panel displays.

The function of display controller 20 when interacting with display memory 18 and display 22 is conventional. In general, each bit of the display memory 18 corresponds to a specific pixel position on the flat panel display 22 (i.e., one bit per pixel), and the display memory 18 stores a bitmap representation of the display image. The display controller 20 typically includes a microcontroller and a digital driver interface having row address lines 25 and column address lines 27 connected to the row and column bus lines, respectively, of the flat panel display 22. During each refresh frame, the microcontroller reads the contents of the display memory 18 and outputs the correct timing signals on the row and column lines 25 and 27 according to the data in the memory 18, to energize the pixels of the LCD panel 22. The digital driver interface preferable consists of bilevel drives which either apply or do not apply a constant voltage to a particular pixel depending upon whether or not its corresponding bit in the display memory 18 is set. The frame rate at which the display 22 is refreshed is established by the display controller 20.

The CPU 12, whose execution is under the control of appropriate firmware in memory 14 and influenced by certain control signals and data received through input/output unit 16, generates data to be displayed as a bitmap image which it writes via data bus 26 to display memory 18. Pursuant to accepted convention, the CPU 12 writes a "1" to a bit of the display memory 18 to activate the corresponding pixel on the flat panel display 22 and writes a "0" to the bit turning it off.

In accordance with the invention, the CPU 12 is provided on a frame-by-frame basis with a signal 24 indicative of a new display refresh frame, which signal preferably is an interrupt signal received from the display controller 20. Ideally, the display controller 20 would inherently have the ability to generate the signal 24 at every frame, for example, by appropriately configuring an internal control register of the display controller 20. Alternatively, the signal 24 may be derived by shunting one of the address lines (e.g., row address 0) from the controller 20 to the interrupt input on the CPU 12. The purpose of signal 24 is to synchronize updating the contents of the display memory 20 by the CPU 12 with refreshing of the flat panel display 22.

The present invention involves a manipulation of the display data based on the frame rate control scheme, whereby the CPU 12 encodes the gray shades into the bitmap image written to the display memory 18, on a frame-by-frame basis. The frame rate control technique, as exemplified in FIG. 2, involves the application of a constant voltage for a constant period of time to the pixels over a number of frames. Gray scales are achieved by either applying or not applying the voltage at each frame to selected pixels for successive frames. In the timing charts of FIG. 2, eight refresh frames are used to constitute a gray scale cycle which may then be repeated. The gray scale cycle in each timing chart has a distinct voltage pattern defining how a pixel is either energized or not energized over successive frames in the eight frame cycle.

Figures 2, 3:
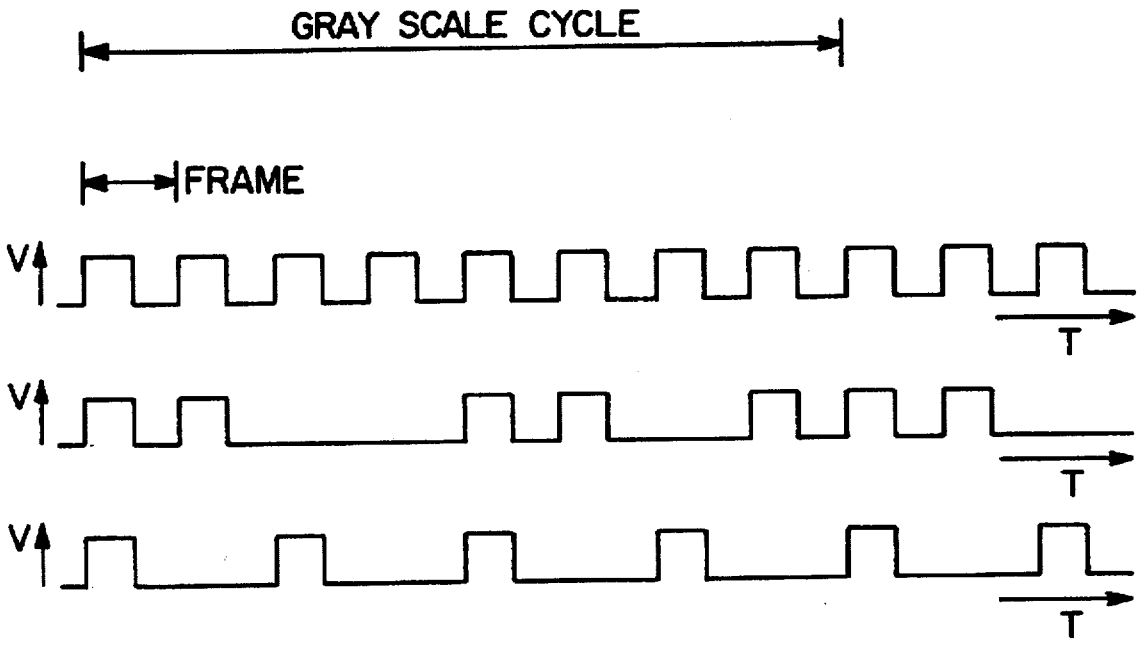
FIG. 2 is an illustrative timing diagram for various gray scale levels.
FIG. 3 is a table representing exemplary pixel energizing patterns for various gray scale levels.
Figure 4:
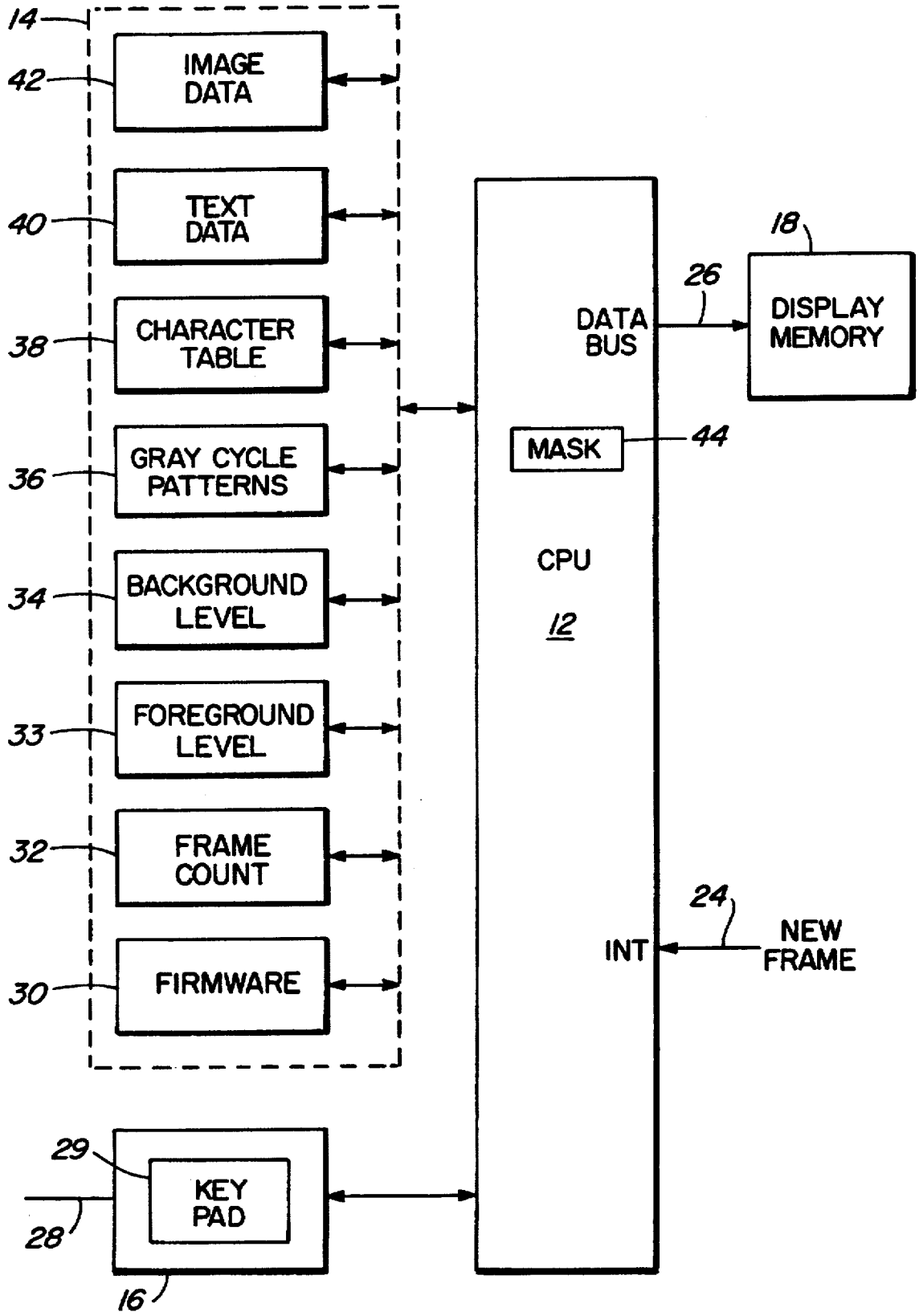
FIG. 4 is a block diagram showing the logical elements comprising the gray scaling algorithm in accordance with the invention.

FIG. 3 is a table showing examples of pixel energizing patterns to effect eight levels of gray shades. Each level is achieved by a predetermined pattern sequence of eight refresh frames according to which pixels are activated at every new frame in the gray scale cycle. Level "0" would result in a pixel being off for the entire cycle and level 5 produces a pixel at full luminance for the cycle. The intermediate levels modulate the luminance of a pixel between these two intensities. It, however, should be understood that the specific patterns shown, the number gray shade levels and the number of frames constituting a gray scale cycle are for purposes of illustration and may be varied to suite the particular application. Care must be taken when designing the frame pattern and cycle to ensure that the resulting gray scale levels produce a linear shading progression which is essentially dependent upon the type of flat panel display 22 being utilized.

Furthermore, a problem generally encountered in the generation of gray shades when using frame rate control techniques is a noticeable flicker in the image being displayed. The present invention overcomes this problem by utilizing a refresh frame of a higher frequency than in conventional display systems. A frame rate of 120 Hz or greater has been found not to generate any noticeable flicker in the displayed image and a rate in the order of 180 Hz is preferred. The frame rate must also be taken into consideration to design the frame energizing pattern and length of the gray cycle.

The following is a description of the bit manipulation algorithm to encode gray scale shading into the bitmap image data. FIG. 5 is a representation of the logical elements in respect of the bit manipulation algorithm being implemented by the CPU 12. The algorithm forms part of the application software which is executed by the CPU 12 and is stored as firmware 30 in memory 14. Internal to the memory 14 also are the logical components Frame Count 32, Foreground Level 33, Background Level 34, Gray Shading Cycle Patterns 36, Character Table 38, Text Data 40 and Image Data 42.

The Frame Count 32 represents a data variable indicating the current frame of the gray scale cycle. It is initially set to one (i.e. first frame) and incremented at each new frame by one to a maximum of eight (i.e. last frame of the gray scale cycle) after which it is reset to one to begin another cycle.

The Foreground Level 33 and Background Level 34 represents individual variables indicative of the level of gray shading for the foreground image and background of the display, respectively. Utilization of separate foreground and background levels is a preferred construction of the invention which, alternatively, in a simpler embodiment may effect gray scale shading on the foreground image only.

The Gray Shading Cycle Patterns 36 are effectively a look-up table of predetermined pixel energizing sequences each defining a unique level of gray scale shading, similar in form to the table illustrated in FIG. 3. In this particular embodiment, one byte (i.e. 8 bits) is used to describe the pixel on/off sequence for eight frames and the eight frame sequence effects a gray scale cycle.

The Character Table 38 constitutes a look-up table containing bitmap images of ASCII characters and any symbolic characters that the display application may support, such as left and right pointing arrow heads. The Text Data 40 represents a character string variable wherein the textual information that is to appear on the display is stored. Each character in the string is identified by a corresponding unique numeric value, typically ASCII values for conventional text characters and other. application defined values for the supported symbolic characters. The numeric value is used to address the character's corresponding bitmap image in the Character Table 38. Generation of bitmap images for characters utilizing look-up tables and text strings is conventional and well understood by practitioners of the art.

The Image Data 42 represents a block of memory corresponding in size to that of the display memory 18 and stores a conventional bitmap representation of the display image, namely as it would normally be written to the display memory without being manipulated according to the invention to effect gray shading.

In the context of a telephone set, the input/output unit 16 may receive data to be displayed through a communication link 28 from the public switched telephone network, for instance the name and number of a person originating a telephone call, which textual data it provides to the CPU 12 which in turn writes the text data into the string variable Text Data 40. The received data may contain special control codes to specify a desired gray scale level for the foreground and background which codes the CPU interprets to record the specified gray scale levels in the Foreground 33 and Background 34 variables accordingly. Preferably, the keypad 29 of the input/output unit 16 on the telephone set includes specific function keys, such as programmed softkeys, whereby a user also may set manually the foreground and background gray scale levels to desired shades. For example, the user may depress softkeys which may be programmed to either increment or decrement in steps of one level the shading of either the foreground or background. The CPU 12 interacts with the input/output unit 16 to determine the appropriate adjustment in the foreground and background levels based on depression of such keys and writes the respective new levels in Foreground Level 33 and Background Level 34.

At every new frame, the CPU 12 is interrupted by signal 24 and in response thereto, the CPU 12 manipulates a source image as a function of the Frame Count 32, Foreground Level 33 and Background Level 34 to generate a gray scale encoded image which it writes to the display memory 18. The Frame Count 32 is appropriately updated, and the above process may be repeated on a frame-by-frame basis.

In one variant of the subject display system, the memory block Image Data 42 may be used to store the source bitmap image. This provides for arbitrary updating of the display contents and supports graphic capabilities. For example, as new textual data is stored in the string variable Text Data 40, immediately thereafter the CPU 12 may convert each character of the new string to its corresponding bitmap representation which is retrieved from Character Table 38 and written to Image Memory 42. Also, graphic routines may be executed by the CPU 12, for instance, to enclose some of the text in a rectangle for highlighting purposes. At each refresh frame, the CPU 12 may retrieve on a per byte basis the data contents of Image Data 42, manipulating each byte according to the set levels for foreground and background shading, and writing the resultant byte to the display memory 18.

In an alternative embodiment relating specifically to a text based display system, at each new frame, the CPU 12 begins by extracting the first character in the string Text Data 40 and locating its corresponding bitmap representation in the Character Table 38. Then the CPU 12 retrieves on a per byte basis the character's bitmap representation, manipulating each byte and writing the resultant byte to the display memory 18. The process is repeated for each character in the string Text Data 40. This particular variant is advantageous over the embodiment including the memory Image Data 40 because less memory is required, but it does not easily support graphics.

The manipulation of the source image involves that the CPU 12 generate an encoding mask 44 and determine a logic operation according to which the mask 44 is applied to the source bitmap image, thereby producing the encoded bitmap image which is written to the display memory 18. The encoding mask 44 may be stored in a register internal to the CPU 12. The CPU 12 uses the values of the Foreground Level 33 and Background Level 34 to address specific frame sequence patterns in the look-up table Gray Scale Cycle Patterns 36 and the value of the Frame Count 32 to address a specific bit within these patterns. Based on the specific foreground bit and background bit, the CPU 12 then generates the encoding mask 44 according to the following table:

TABLE 1

| Foreground | Background | Bit Mask | Operation | Result |
|---|---|---|---|---|
| 0 | 0 | 00000000 | AND | All bits cleared |
| 1 | 0 | no mask | | Identical |
| 0 | 1 | 11111111 | XOR | Complemented |
| 1 | 1 | 11111111 | OR | All bits set |

The mask 44 is applied by the CPU 12 to the source bitmap image according to the corresponding logic operation adjacent the derived mask value thereby achieving the indicated results. It is noted that when the foreground bit is 1 and background bit is 0, a mask is not required and the source image may be reproduced identically in the display memory 18. Also, in the simpler embodiment which is only concerned with gray scale shading of the foreground image, the first two lines of the above table (i.e., Background bit is 0) define the relevant masks and corresponding operations.

Figure 5A:
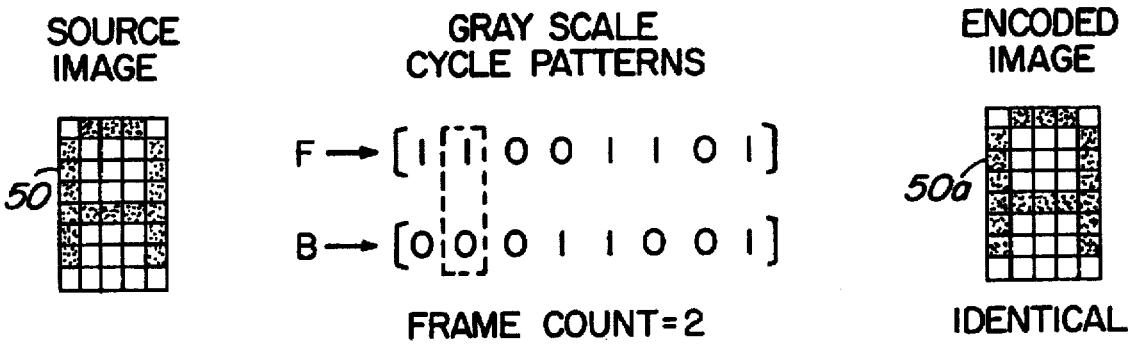
FIGS. 5*a*, 5*b*, 5*c* and 5*d* are explanatory illustrations of gray scale encoded images.
Figure 5B:
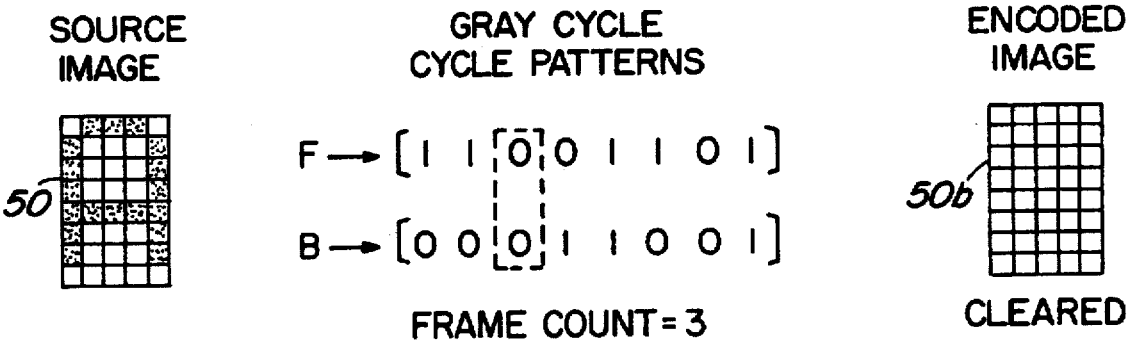
Figure 5C:
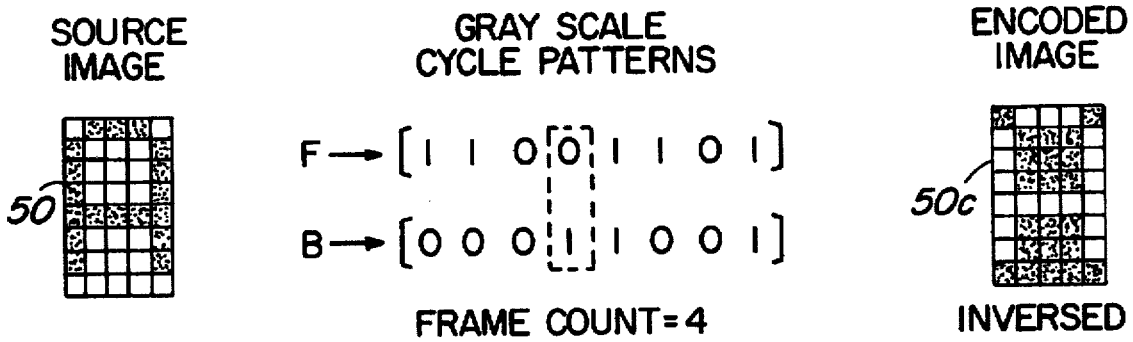
Figure 5D:
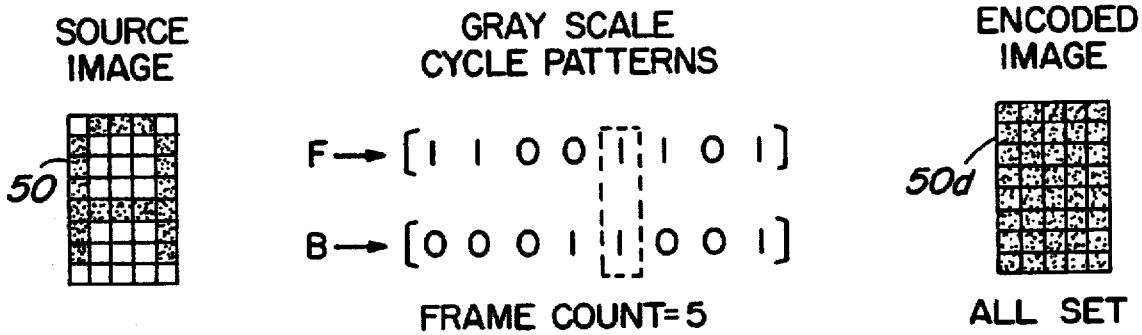

FIGS. 5*a*, 5*b*, 5*c* and 5*d* are explanatory illustrations of the bit manipulation operations listed in Table 1, which should assist in understanding the process of encoding shading into the image data written to the display memory 18. In these figures, the Foreground Level and Background Level, represented by the letters F and B respectively, index separate frame patterns in a Gray Scale Cycle look-up table and the source bitmap image 50 is a representation of the character "A". Turning to FIG. 5*a*, the value of Frame Count is currently at two which corresponds to the second frame of the gray scaling cycle. Accordingly, the second bit within the foreground and background patterns is addressed returning a 1 and 0, respectively, for which no manipulation of the source bitmap is required and thus the encoded bitmap image 50*a* is identical to the source image 50. In FIG. 5*b*, the value of Frame Count was incremented to three which returns bit values of 0 and 0 from the respective foreground and background patterns. The source image 50 is manipulated, according to Table 1, by applying a bit mask of 00 (HEX) with the logical operator AND to the bitmap of the source image 50 thereby generating an encoded image 50*b* in which all bits have been cleared. In FIG. 5*c*, Frame Count has been incremented to four which returns bit values of 0 and 1 from the respective foreground and background patterns. In accordance with Table 1, manipulation of the source bitmap image 50, through application thereto of a bit mask of FF (HEX) with the XOR logic operation, generates an encoded image 50*c* having bit values which are the complement of the source image 50. Lastly, in FIG. 5*d*, the Frame Count equals five returning bit values of 1 and 1 from the foreground and background bit patterns, respectively, according to which the source image 50 is manipulated by applying to it an FF (HEX) bit mask with the OR logical operation to generate an encoded bitmap image 50*d* in which all bits are set.

In summary, the software implementation of the frame rate control technique is a low cost and efficient solution to implement both gray scales on monochrome displays and various shades of color on electrically controlled birefringence color displays. As bit manipulation is performed using fast CPU instructions, namely logic OR, XOR and AND, in one instance of real time operation, execution of the algorithm utilized no more than 10% of the processing time at a bus cycle of 125 nanoseconds.

Those skilled in the art will recognize that various modifications and changes could be made to the invention without departing from the spirit and scope thereof. It should therefore be understood that the claims are not to be considered as being limited to the precise embodiments of the display system set forth above, in the absence of specific limitations directed to each embodiment.

We claim:

1. A method for use in a display system to encode shading in an image to be displayed, the system including a video display having a plurality of pixel elements each being mapped to a respective bit within a memory, and a controller for energizing, at a predetermined frame refresh rate, the pixel elements according to an image bitmap stored in the memory, the method comprising the steps of:

generating a source bitmap representative of the image;

specifying an energizing pattern of successive frames, the pattern defining the shading by indicating for each frame whether the pixels of the display generally are to be on or off;

generating, substantially at the refresh rate, an encoded bitmap by manipulating bits of the source bitmap as a function of the energizing pattern for each of the frames; and storing the encoded bitmap in the memory.

2. A method as claimed in claim 1, wherein the step of generating the encoded bitmap comprises:

maintaining, at frames the pattern indicates the pixels of the display to be on, the bits of the source bitmap as the encoded bitmap; and clearing, at frames the pattern indicates the pixels of the display to be off, the bits of the source bitmap as the encoded bitmap.

3. A method as claimed in claim 2, wherein the step of clearing the bits of the source bitmap comprises applying a bit mask of 00 (HEX) with a logical operation of AND to the source bitmap.

4. A method as claimed in claim 3, further comprising the step of generating a plurality of predetermined energizing patterns, each defining a level of shading, and wherein specifying the energizing pattern comprises selecting from the plurality of predetermined energizing patterns the pattern for a desired level of shading.

5. A method as claimed in claim 1, further comprising the step of specifying another energizing pattern, and wherein the step of generating the encoded bitmap comprises:

maintaining, at frames the pattern indicates the pixels of the display to be on and the another pattern indicates the pixels to be off, the bits of the source bitmap as the encoded bitmap;

clearing, at frames the pattern indicates the pixels of the display to be off and the another pattern indicates the pixels to be off, the bits of the source bitmap as the encoded bitmap;

complementing, at frames the pattern indicates the pixels of the display to be off and the another pattern indicates the pixels to be on, the bits of the source bitmap as the encoded bitmap; and setting, at frames the pattern indicates the pixels of the display to be on and the another pattern indicates the pixels to be on, the bits of the source bitmap as the encoded bitmap.

6. A method as claimed in claim 5, wherein the step of clearing the bits of the source bitmap comprises applying a bit mask of 00 (HEX) with a logical operation of AND to the source bitmap.

7. A method as claimed in claim 6, wherein the step of complementing the bits of the source bitmap comprises applying a bit mask of FF (HEX) with a logical operation of XOR to the source bitmap.

8. A method as claimed in claim 7, wherein the step of setting the bits of the source bitmap comprises applying a bit mask of FF (HEX) with a logical operation of OR to the source bitmap.

9. A method as claimed in claim 5, further comprising the step of generating a plurality of predetermined energizing patterns, each defining a level of shading, and wherein specifying the energizing pattern comprises selecting the pattern and the another pattern from the plurality of predetermined energizing patterns.

10. A method for use in a display system to encode shading in an image to be displayed, the system including a video display having a plurality of pixel elements each being mapped to a respective bit within a memory, and a controller for energizing, at a predetermined frame refresh rate, the pixel elements according to an image bitmap stored in the memory, the method comprising the steps of:

generating a source bitmap consisting of a foreground and a background of the image;

specifying first and second energizing patterns, each pattern defining a level of shading by indicating for successive frames whether the pixels of the display generally are to be on or off, the first pattern being the level of shading for the foreground and the second pattern being the level of shading for the background;

generating, substantially at the refresh rate, an encoded bitmap by manipulating bits of the source bitmap as a function of the first and second energizing patterns for each of the frames; and storing the encoded bitmap in the memory.

11. A method as claimed in claim 10, wherein the step of generating the encoded bitmap comprises:

maintaining, at frames the first pattern indicates the pixels of the display to be on and the second pattern indicates the pixels to be off, the bits of the source bitmap as the encoded bitmap;

clearing, at frames the first pattern indicates the pixels of the display to be off and the second pattern indicates the pixels to be off, the bits of the source bitmap as the encoded bitmap;

complementing, at frames the first pattern indicates the pixels of the display to be off and the second pattern indicates the pixels to be on, the bits of the source bitmap as the encoded bitmap; and setting, at frames the first pattern indicates the pixels of the display to be on and the second pattern indicates the pixels to be on, the bits of the source bitmap as the encoded bitmap.

12. A method as claimed in claim 11, wherein the step of clearing the bits of the source bitmap comprises applying a bit mask of 00 (HEX) with a logical operation of AND to the source bitmap.

13. A method as claimed in claim 12, wherein the step of complementing the bits of the source bitmap comprises applying a bit mask of FF (HEX) with a logical operation of XOR to the source bitmap.

14. A method as claimed in claim 13, wherein the step of setting the bits of the source bitmap comprises applying a bit mask of FF (HEX) with a logical operation of OR to the source bitmap.

15. A method as claimed in claim 11, wherein the step of generating the source bitmap comprises retrieving a text string of characters; and retrieving, for each character in the string, the character's corresponding bitmap representation from a table of character bitmaps.

16. A display system that encodes shading in an image to be displayed, comprising:

a video display having a plurality of pixel elements each being mapped to a respective bit within a memory;

a controller for energizing, at a predetermined frame refresh rate, the pixel elements according to an image bitmap stored in the memory;

a source bitmap representative of the image;

an energizing pattern of successive frames, the pattern defining the shading by indicating for each frame whether the pixels of the display generally are to be on or off; and means for generating, substantially at the refresh rate, an encoded bitmap by manipulating bits of the source bitmap as a function of the energizing pattern for each of the frames, and storing the encoded bitmap in the memory.

17. A display system as claimed in claim 16, wherein the means for generating the encoded bitmap comprises:

means for maintaining, at frames the pattern indicates the pixels of the display to be on, the bits of the source bitmap as the encoded bitmap; and means for clearing, at frames the pattern indicates the pixels of the display to be off, the bits of the source bitmap as the encoded bitmap.

18. A display system as claimed in claim 17, comprising a plurality of predetermined energizing patterns, each defining a level of shading, and means for selecting from the plurality of predetermined energizing patterns the pattern for a desired level of shading.

19. A display system as claimed in claim 16, comprising another energizing pattern, and wherein the means for generating the encoded bitmap comprises:

means for maintaining, at frames the pattern indicates the pixels of the display to be on and the another pattern indicates the pixels to be off, the bits of the source bitmap as the encoded bitmap;

means for clearing, at frames the pattern indicates the pixels of the display to be off and the another pattern indicates the pixels to be off, the bits of the source bitmap as the encoded bitmap;

means for complementing, at frames the pattern indicates the pixels of the display to be off and the another pattern indicates the pixels to be on, the bits of the source bitmap as the encoded bitmap; and means for setting, at frames the pattern indicates the pixels of the display to be on and the another pattern indicates the pixels to be on, the bits of the source bitmap as the encoded bitmap.

20. A display system as claimed in claim 19, comprising a plurality of predetermined energizing patterns, each defining a level of shading, and means for selecting the pattern and the another pattern from the plurality of predetermined energizing patterns.

21. A display system that encodes shading in an image to be displayed, comprising:

a video display having a plurality of pixel elements each being mapped to a respective bit within a memory;

a controller for energizing, at a predetermined frame refresh rate, the pixel elements according to an image bitmap stored in the memory;

a source bitmap consisting of a foreground and a background of the image;

first and second energizing patterns, each pattern defining a level of shading by indicating for successive frames whether the pixels of the display generally are to be on or off, the first pattern being the level of shading for the foreground and the second pattern being the level of shading for the background; and means for generating, substantially at the refresh rate, an encoded bitmap by manipulating bits of the source bitmap as a function of the first and second energizing patterns for each of the frames, and storing the encoded bitmap in the memory.

22. A display system as claimed in claim 21, wherein the means for generating the encoded bitmap comprises:

means for maintaining, at frames the first pattern indicates the pixels of the display to be on and the second pattern indicates the pixels to be off, the bits of the source bitmap as the encoded bitmap;

means for clearing, at frames the first pattern indicates the pixels of the display to be off and the second pattern indicates the pixels to be off, the bits of the source bitmap as the encoded bitmap;

means for complementing, at frames the first pattern indicates the pixels of the display to be off and the second pattern indicates the pixels to be on, the bits of the source bitmap as the encoded bitmap; and means for setting, at frames the first pattern indicates the pixels of the display to be on and the second pattern indicates the pixels to be on, the bits of the source bitmap as the encoded bitmap.

23. A display system as claimed in claim 22, wherein the video display is a liquid crystal flat panel display.

24. A display system as claimed in claim 22, wherein the video display is an electrically controlled birefringence color flat panel display.

25. A method as claimed in claim 5, wherein the predetermined frame refresh rate is greater than about 120 Hz.

26. A method as claimed in claim 25, wherein the predetermined frame refresh rate is about 180 Hz.

27. A method as claimed in claim 11, wherein the predetermined frame refresh rate is greater than about 120 Hz.

28. A method as claimed in claim 27, wherein the predetermined frame refresh rate is about 180 Hz.

* * * * *